US008881968B2

(12) United States Patent
Coleman, Jr.

(10) Patent No.: US 8,881,968 B2
(45) Date of Patent: Nov. 11, 2014

(54) RECYCLABLE FOOD CONTAINER HAVING DETACHABLE PRODUCT SUPPORT PAD

(75) Inventor: Casey E. Coleman, Jr., Loganville, GA (US)

(73) Assignee: Pratt Industries, Inc., Conyers, GA (US)

( * ) Notice: Subject to any disclaimer, the term of this patent is extended or adjusted under 35 U.S.C. 154(b) by 767 days.

(21) Appl. No.: 12/605,726

(22) Filed: Oct. 26, 2009

(65) Prior Publication Data

US 2010/0108750 A1 May 6, 2010

Related U.S. Application Data

(60) Provisional application No. 61/108,187, filed on Oct. 24, 2008.

(51) Int. Cl.

| | |
|---|---|
| ***B65D 5/54*** | (2006.01) |
| ***B65D 5/00*** | (2006.01) |
| ***B31B 1/14*** | (2006.01) |
| ***B65D 5/50*** | (2006.01) |
| ***B65D 5/66*** | (2006.01) |

(52) U.S. Cl.

CPC ..... *B65D 5/6658* (2013.01); *B65D 2585/366* (2013.01); *B65D 5/5028* (2013.01); *Y10S 229/906* (2013.01)

USPC ..... 229/110; 229/200; 229/906; 493/56

(58) Field of Classification Search

CPC ..... B65D 5/6658; B65D 5/5028; B65D 2585/366

USPC ..... 229/200, 126, 902, 904, 122.32, 229/122.34, 120.06, 120.32, 101.2

See application file for complete search history.

(56) References Cited

U.S. PATENT DOCUMENTS

| | | | |
|---|---|---|---|
| 4,441,626 | A | 4/1984 | Hall |
| D274,889 | S | 7/1984 | Sullivan |
| 4,476,989 | A | 10/1984 | Larsen |
| D292,176 | S | 10/1987 | Kuerti |
| 4,960,238 | A | 10/1990 | Lorenz |
| 4,995,557 | A | 2/1991 | Fremion |
| D326,358 | S | 5/1992 | Rothbard |
| 5,110,038 | A | 5/1992 | Pantisano et al. |
| 5,170,903 | A | 12/1992 | Fleming |
| 5,209,392 | A | 5/1993 | Anatro |
| 5,234,158 | A | 8/1993 | Storms et al. |
| 5,305,949 | A | 4/1994 | Linden |
| 5,328,258 | A | 7/1994 | Scalise |
| 5,375,761 | A | 12/1994 | Sullivan et al. |
| 5,385,292 | A | 1/1995 | Labianca et al. |
| D356,254 | S | 3/1995 | Correll |
| 5,402,930 | A | 4/1995 | Storms et al. |

(Continued)

*Primary Examiner* — Gary Elkins
*Assistant Examiner* — Christopher Demeree
(74) *Attorney, Agent, or Firm* — Taylor English Duma LLP

(57) ABSTRACT

The various embodiments of the present invention comprise a single blank design for a recyclable food container, which includes a majority recyclable portion and a detachable product support pad portion. Once the blank is erected, the detachable product support pad forms the base of the food container and may bear the weight of food product, such as pizza. After use by a consumer, the soiled detachable product support pad may be detached and discarded, thus allowing the remainder of the food container to be recycled. The detachable product support pad also protects the other parts of the food container from grease or other food by-products, thus encouraging recyclability.

16 Claims, 5 Drawing Sheets

(56) References Cited

U.S. PATENT DOCUMENTS

| | | | | |
|---|---|---|---|---|
| 5,423,477 | A | 6/1995 | Valdman et al. | |
| 5,445,314 | A | 8/1995 | Newsome | |
| D362,803 | S | 10/1995 | McMullen | |
| 5,472,139 | A | 12/1995 | Valdman et al. | |
| 5,476,214 | A | 12/1995 | Fisk, Jr. | |
| 5,480,031 | A | 1/1996 | Maultasch et al. | |
| D368,657 | S | 4/1996 | Newell | |
| D371,296 | S | 7/1996 | Correll | |
| D372,862 | S | 8/1996 | Fiori | |
| D390,110 | S | 2/1998 | Mario | |
| 5,794,999 | A | 8/1998 | Corsaro | |
| 5,880,435 | A | 3/1999 | Bostic | |
| 5,881,948 | A | 3/1999 | Correll | |
| 5,918,797 | A | 7/1999 | Correll | |
| 5,961,035 | A | 10/1999 | Correll | |
| 6,016,951 | A | 1/2000 | Correll | |
| D420,583 | S | 2/2000 | Cooper, Jr. | |
| 6,065,669 | A | 5/2000 | Correll | |
| 6,070,791 | A | 6/2000 | Correll | |
| 6,092,715 | A | 7/2000 | Correll | |
| 6,222,987 | B1 | 4/2001 | Duke et al. | |
| 6,440,050 | B1 * | 8/2002 | Capparelli et al. | 493/59 |
| 6,446,859 | B1 | 9/2002 | Holladay | |
| 6,749,106 | B2 | 6/2004 | Keefe, Jr. et al. | |
| 6,752,311 | B2 * | 6/2004 | Tulkoff | 229/104 |
| 6,834,762 | B2 | 12/2004 | Krisko et al. | |
| 6,851,603 | B1 | 2/2005 | Carlson et al. | |
| D506,671 | S | 6/2005 | Tilley et al. | |
| 6,905,065 | B2 | 6/2005 | Holden | |
| 6,938,820 | B2 | 9/2005 | Noone et al. | |
| D510,264 | S | 10/2005 | Tilley et al. | |
| 6,966,483 | B2 | 11/2005 | Manninen | |
| 7,051,919 | B1 | 5/2006 | Walsh | |
| D529,346 | S | 10/2006 | Charuwongkhachton | |
| 7,191,902 | B1 | 3/2007 | Nelson et al. | |
| 7,380,702 | B2 * | 6/2008 | Oddo | 229/104 |
| 2002/0121542 | A1 | 9/2002 | Holladay | |
| 2004/0188278 | A1 | 9/2004 | Krisko et al. | |
| 2005/0017063 | A1 | 1/2005 | Noone et al. | |
| 2006/0022026 | A1 | 2/2006 | Yandian et al. | |
| 2006/0131369 | A1 * | 6/2006 | Oddo | 229/104 |

* cited by examiner

RECYCLABLE FOOD CONTAINER HAVING DETACHABLE PRODUCT SUPPORT PAD

CROSS-REFERENCE TO RELATED APPLICATIONS

This application is a nonprovisional patent application, claiming priority to U.S. provisional application No. 61/108,187, filed Oct. 24, 2008, which is hereby incorporated herein in its entirety by reference.

BACKGROUND OF THE INVENTION

Consumers, companies, and governments are becoming more concerned about the environment and the capacity of landfills. Thus, the recycling of materials is becoming increasingly important.

Recycling materials including food waste poses a problem in the recycling industry. Containers including food waste and food-soiled materials often can only be composted rather than recycled into new containers. In the instance of cardboard containers, this problem is unfortunate, as cardboard is one of the easiest materials to recycle.

It would be desirable to minimize the amount of food-soiled materials, such as cardboard, that are sent to landfills or sent to composting facilities, and increase the amount of cardboard that is recycled into new containers because there is a strong need for recycled containers in the industry.

BRIEF SUMMARY OF THE INVENTION

The various embodiments of the present invention provide improvements over the prior art by providing a recyclable food container that includes a detachable product support pad (a.k.a., a removable food supporting portion or "trash pad").

Generally described, the present invention relates to a single blank formable into an erected food container for containing a food product, the food container comprising: a recyclable portion; and a detachable product support portion configured to cooperate with the recyclable portion to at least partially contain the food product when the food container is erected, the detachable product support portion configured to support the food product when the food is so contained, and the detachable product support portion being detachable from the recyclable portion upon being soiled by food product.

The present invention also relates to the blank as described in the previous paragraph, wherein the recyclable portion is foldably attached relative to the detachable product support portion, the foldable attachment being substantially along a tearable hinge suitable for tearing such that the product support portion is detached from the recyclable portion.

The present invention also relates to the blank as described in the previous paragraph, wherein the recyclable portion includes a cover panel and also includes a main base portion foldably attached relative to the cover panel along a first fold line, and wherein the detachable product support portion is foldably attached relative to the main base panel along a second fold line, the first and second fold lines being spaced apart.

The present invention also relates to the blank as described in the previous paragraph, wherein the first and second fold lines are substantially parallel.

Generally described, the present invention also relates to a single blank formable into a pizza box defining a storage location for containing a food product, the storage location being partially defined by a floor portion for supporting the weight of the food product, the pizza box comprising: A) a cover itself comprising at least a main top panel configured to be positioned above the food product when the pizza box is in its conventional intended use; B) a rear wall connected to the top panel; and C) a body itself comprising: 1) a main base panel attached to the rear wall; and 2) a detachable product support pad attached to the main base panel along a tearable hinge, the main base panel and the detachable product support pad being folded along the tearable hinge such that at least a portion of the main base panel overlies at least a portion of the detachable product support pad to form an overlaid double thickness portion, such that when the blank is formed into a pizza box, the detachable product support pad is spaced apart from the top panel of the cover to at least partially define the food product storage location therebetween, such that the detachable product support pad defines the floor portion of the storage location during conventional intended use of the pizza box, and such that the detachable product support pad can be detached.

The present invention also relates to the blank as described in the previous paragraph, wherein the detachable product support pad is configured to be detached relative to the main base panel of the body of the pizza box should it become soiled, by tearing along said tearable hinge, such that the detachable product support pad may be disposed in a location different from the remainder of the pizza box.

The present invention also relates to the blank as described in the previous paragraph, wherein the tearable hinge is non-contiguous and includes at least two spaced apart portions.

The present invention also relates to the blank as described in the previous paragraph, wherein the rear wall is attached relative to the main base panel along a first fold line, and the tearable hinge lies along a second fold line, and the first and second fold lines are substantially parallel.

Generally described, the present invention also relates to a method of forming a pizza box defining a storage location for containing a food product, the storage location being partially defined by a floor portion for supporting the weight of the food product, the method comprising the steps of: A) providing a blank itself including: 1) a cover itself comprising at least a main top panel configured to be positioned above the food product when the pizza box is in its conventional intended use; 2) a rear wall connected to the top panel; and 3) a body itself comprising: a) a main base panel attached to the rear wall; and b) a detachable product support pad attached to the main base panel along a tearable hinge, the main base panel and the detachable product support pad being folded along the tearable hinge such that at least a portion of the main base panel overlies at least a portion of the detachable product support pad to form an overlaid double thickness portion, B) forming the blank into a pizza box such that the detachable product support pad is spaced apart from the top panel of the cover to at least partially define the food product storage location therebetween, such that the detachable product support pad defines the floor portion of the storage location during conventional intended use of the pizza box; and C) detaching the detachable product support pad by tearing the blank substantially along the tearable hinge.

The present invention also relates to the method as described in the previous paragraph at step "A", further comprising step "D", subsequent to step "C", step "D" comprising disposing the detachable product support pad in a location different from the remainder of the pizza box.

The present invention also relates to the method as described in the previous paragraph at step "B", the rear wall is folded relative to the main base panel along a first fold line, and the tearable hinge lies along a second fold line, and the detachable product support pad is folded relative to the main base panel along a first fold line being substantially along the tearable hinge, and wherein the first and second fold lines are substantially parallel.

Generally described, the present invention also relates to a blank for a pizza box, the blank comprising: A) a top cover member (later will include cover and rear wall) comprising at least a main top panel configured to be positioned above the food product when the pizza box is in its conventional intended use; and B) a body itself comprising: 1) a main base panel attached to the top cover member along a fold line lying substantially along a first axis; and 2) a detachable product support pad attached to the main base panel along a tearable hinge lying substantially along a second axis, the main base panel and the detachable product support pad being foldable along the tearable hinge such that at least a portion of the main base panel overlies at least a portion of the detachable product support pad to form an overlaid double thickness portion, the detachable product support pad being detachable relative to the body by tearing the blank along the tearable hinge.

The present invention also relates to the blank as described in the previous paragraph, wherein the top cover member includes a cover including the main top panel, and the top cover member also includes a rear wall connected to the main top panel along a fold line.

The present invention also relates to the blank as described in the previous paragraph, wherein the rear wall is attached relative to the main base panel along a first fold line, and the tearable hinge lies along a second fold line, and the first and second fold lines are substantially parallel.

The present invention also relates to the blank as described in the previous paragraph, further comprising a side panel foldably attached relative to the main base panel along a third fold line, the second and third fold lines being substantially perpendicular.

Therefore, it is an aspect of the present invention to provide a food container with a detachable product support pad.

It is a further aspect of the invention to provide a food container which may be compacted after use for ease of recycling.

It is a further aspect of the invention to provide a food container with a removable food supporting portion which includes space saving features.

It is a further aspect of the invention to provide a food container with a detachable product support pad which is easily erectable.

It is a further aspect of the invention to provide a method of manufacturing a food container with a detachable product support pad.

It is a further aspect of the invention to provide a method of erecting a food container with a detachable product support pad.

Other objects, features, and advantages of the present invention will become apparent upon reading the following detailed description of the various embodiments of the invention when taken in conjunction with the drawings and the appended claim concepts.

BRIEF DESCRIPTION OF THE SEVERAL VIEWS OF THE DRAWINGS

Figure 1:
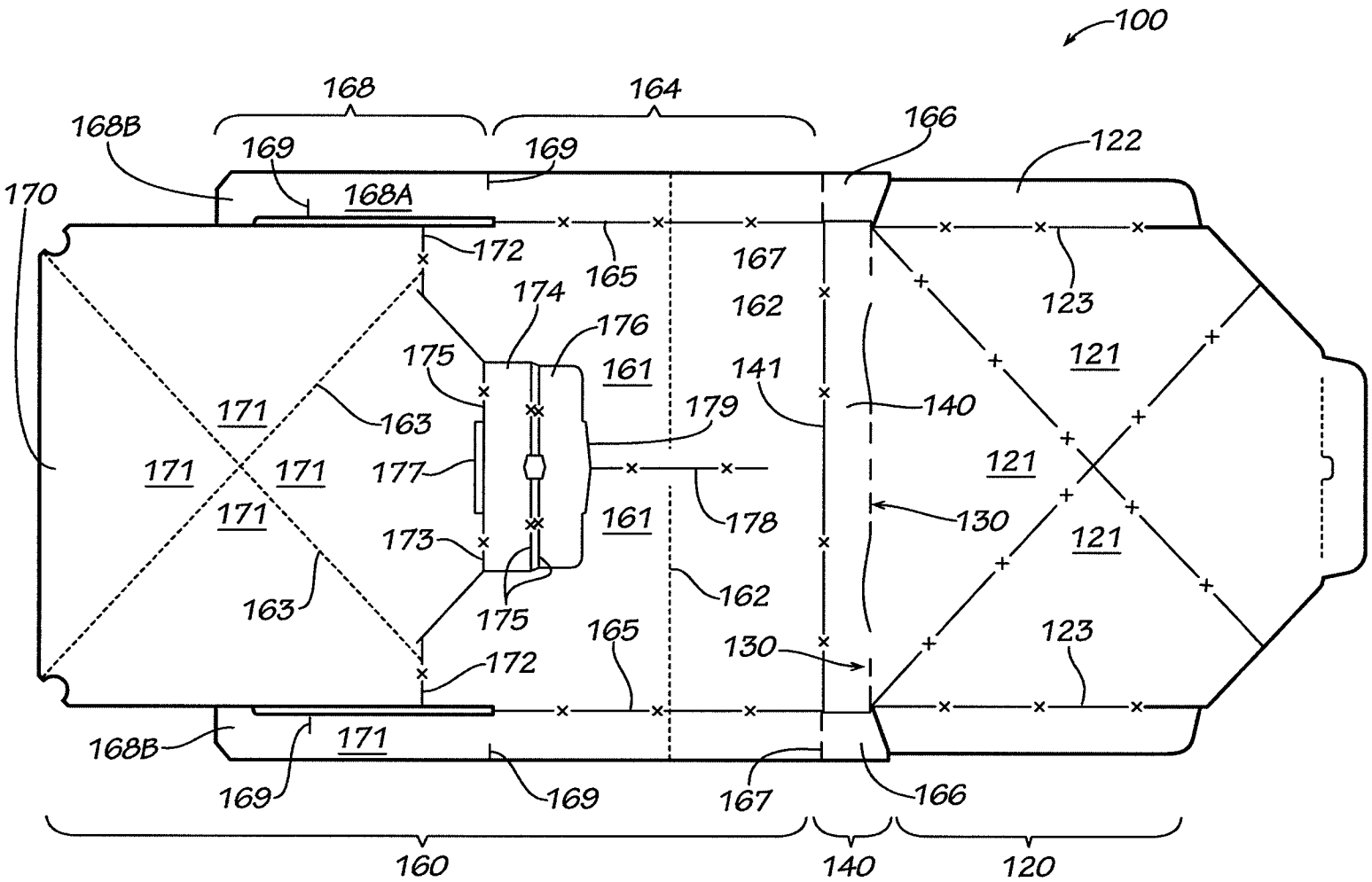

Having thus described various embodiments of the invention in general terms, reference will now be made to the accompanying drawings, which are not necessarily drawn to scale, and wherein:

FIG. 1 is a top plan view of a blank 100 comprising a first embodiment of the present invention.

Figure 2:
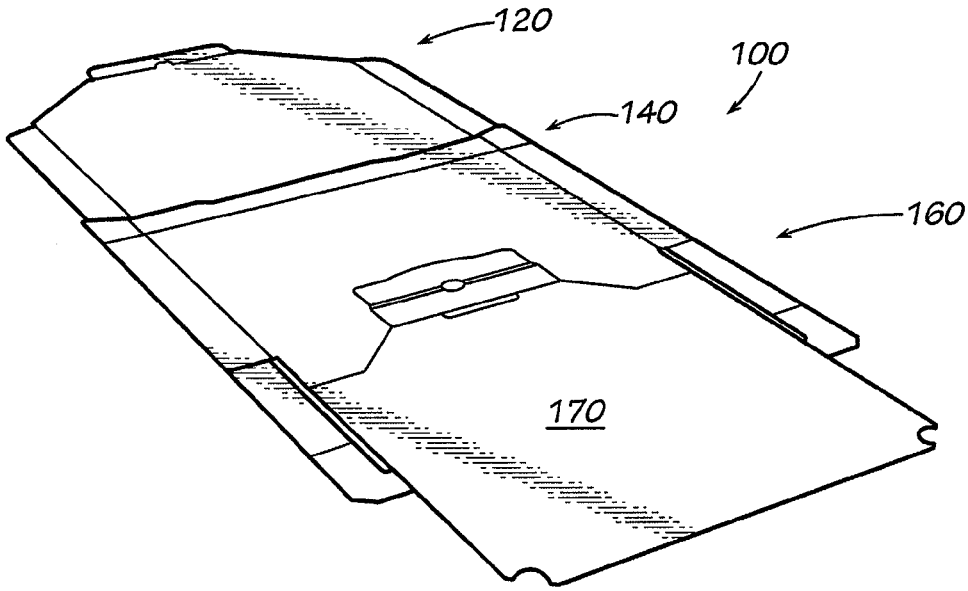

FIG. 2 is a perspective view of a blank 100 for a food container in an unassembled, flat, state in accordance with an embodiment of the invention.

Figure 3:
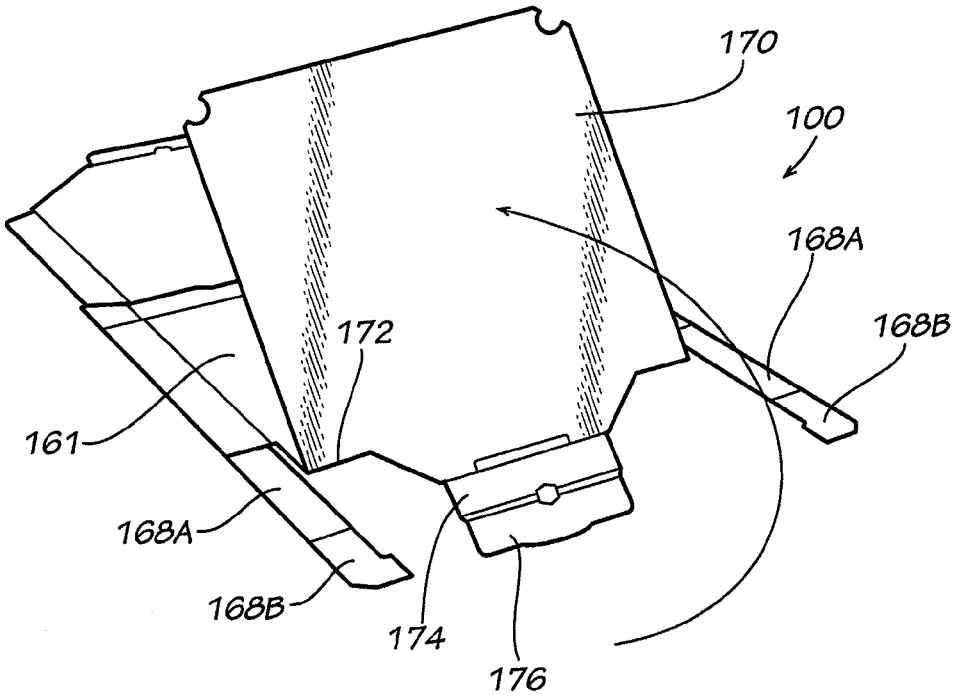

FIG. 3 is a perspective view of a blank 100 for a food container in a first stage of assembly in accordance with an embodiment of the invention.

Figure 4:
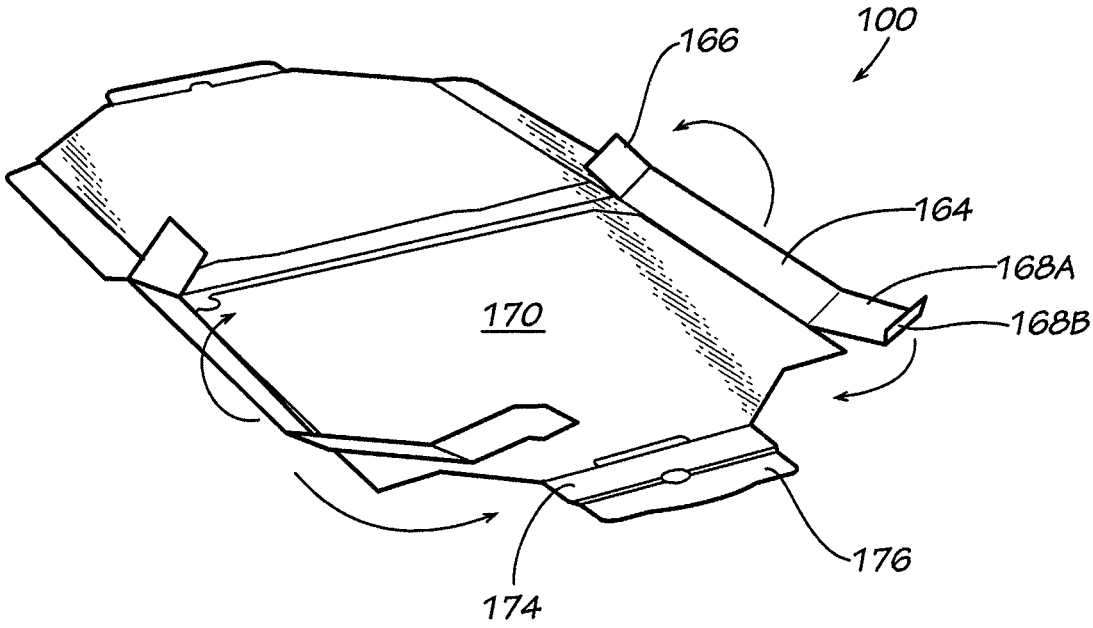

FIG. 4 is a perspective view of a blank 100 for a food container in a second stage of assembly in accordance with an embodiment of the invention.

Figure 5:
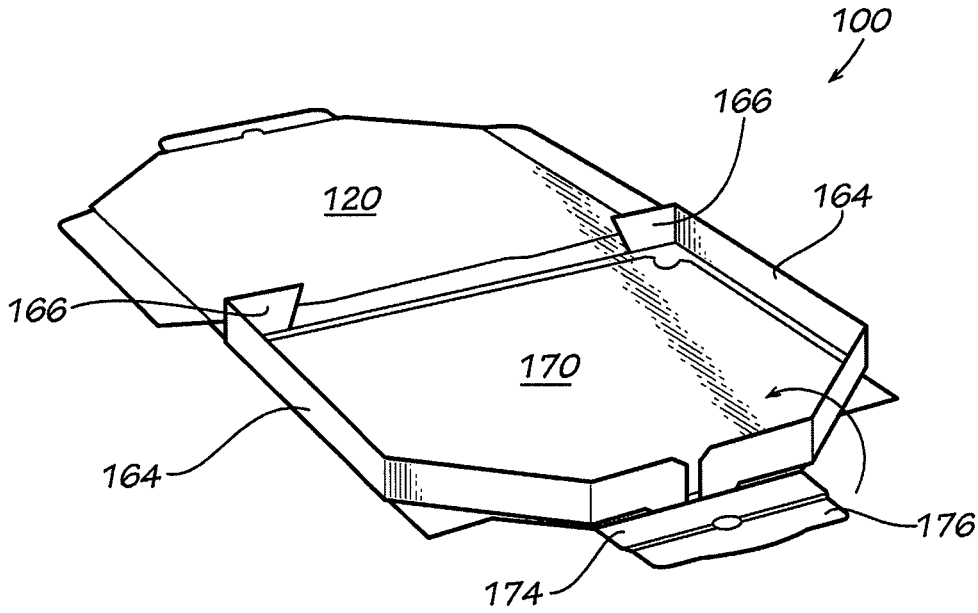

FIG. 5 is a perspective view of a blank 100 for a food container in a third stage of assembly in accordance with an embodiment of the invention.

Figure 6:
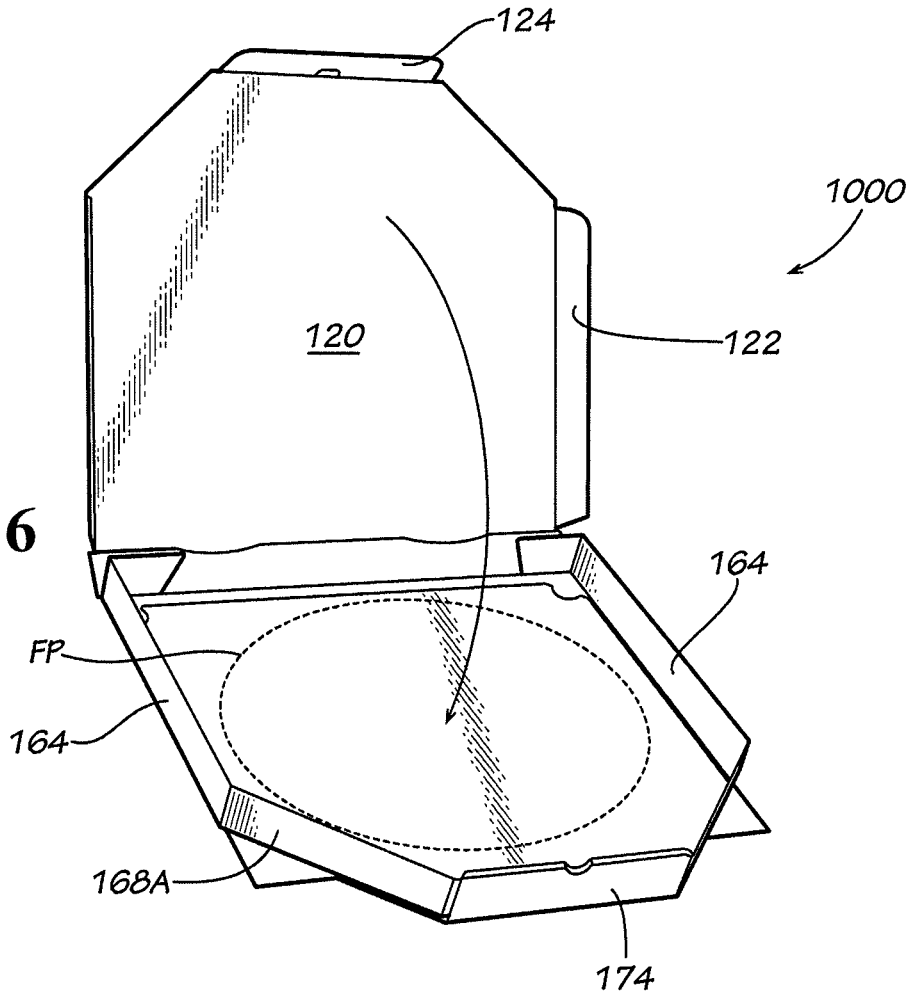

FIG. 6 is a perspective view of an erected food container or carton 1000 for food containment in accordance with an embodiment of the invention, said food container being in a configuration suitable for loading food product FP such as shown in dotted line.

Figure 7:
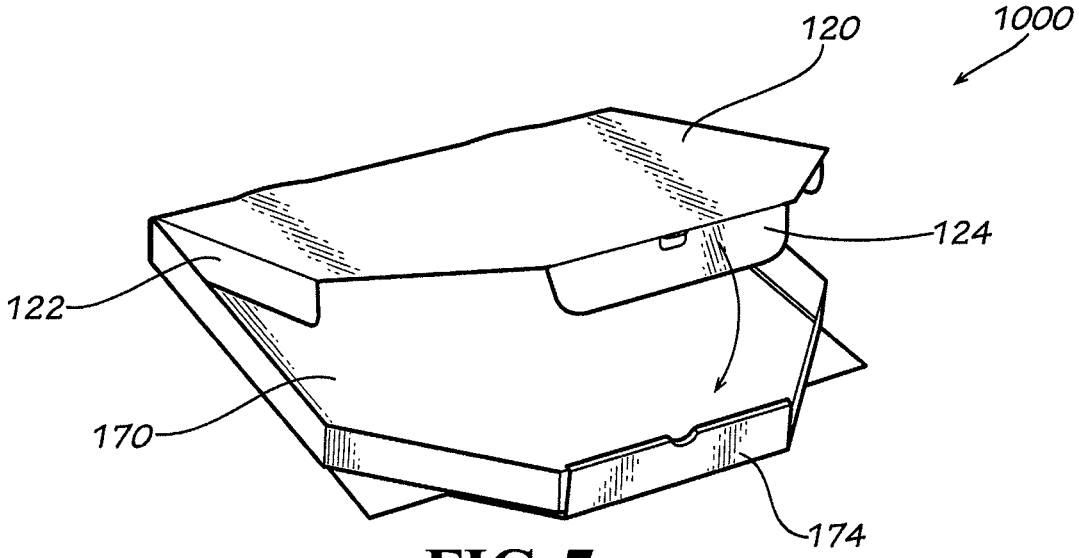

FIG. 7 is a perspective view of erected food container or carton 1000 for food containment in accordance with an embodiment of the invention, with the arrow showing the final closing step.

Figure 8:
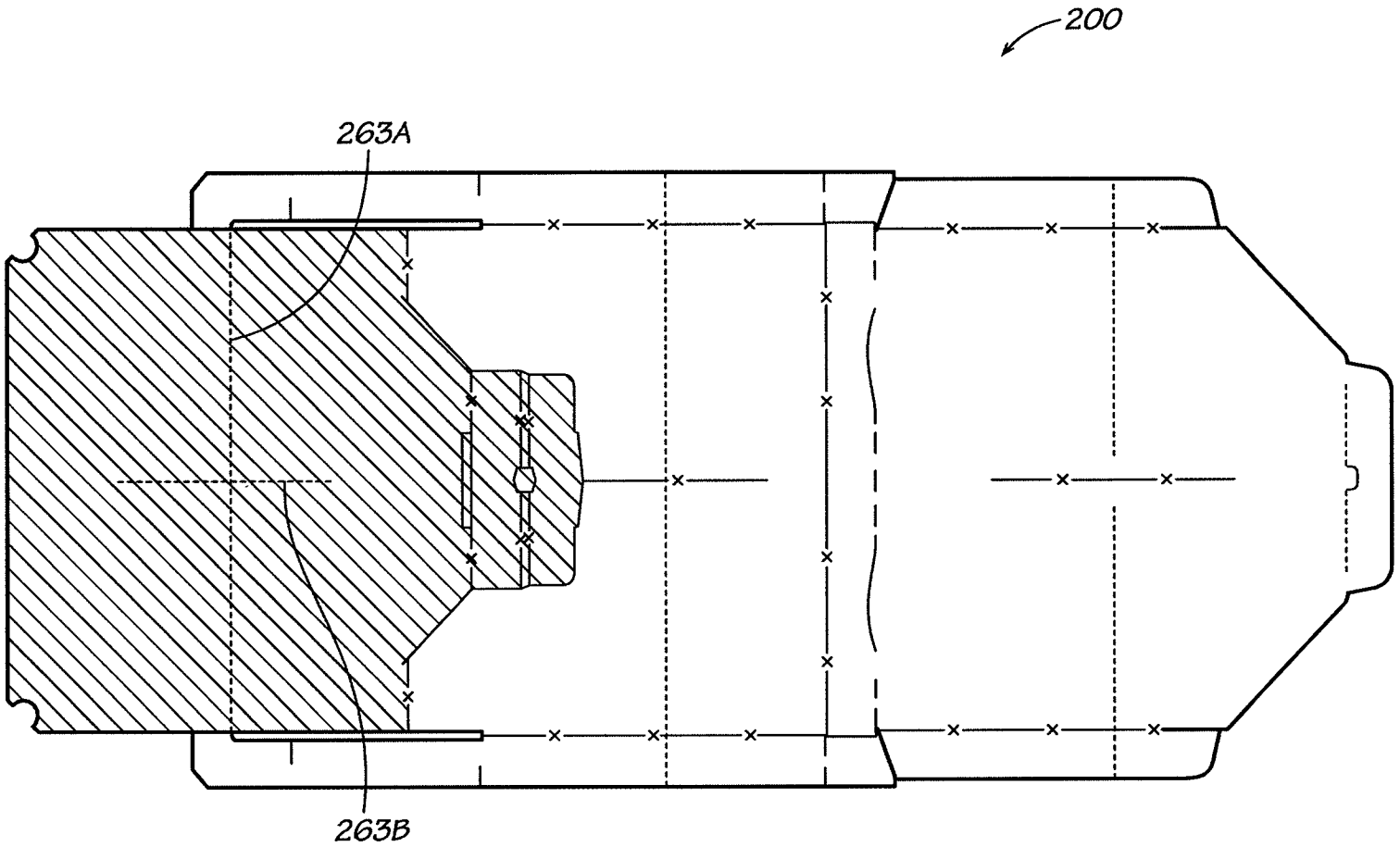

FIG. 8 is a top plan view of a blank 200 comprising a second embodiment of the present invention.

DETAILED DESCRIPTION OF THE INVENTION

Various embodiments of the present invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements. Like numbers refer to like elements throughout.

General Construction and Use

Generally described, the present invention comprises a single blank design for a recyclable food container, which includes a majority recyclable portion, with a detachable product support pad (a.k.a. "trash pad"). The present invention also includes a method of erecting, as well as manufacturing, the blank. Once the blank is erected into a food container, the detachable product support pad forms the base of the food container and may bear the weight of food product. After use by a consumer, if soiled by for example food, oil, or grease, the detachable product support pad may be detached and discarded with other food wastes, thus allowing the remainder of the food container to be recycled.

The food container of the present invention provides an improvement over the known prior art by allowing consumers to easily separate the detachable product support pad from the food container as needed for proper disposal, satisfying a significant waste disposal need that is well recognized in the industry.

ELEMENT LIST

100—Blank (First Embodiment)
120—Cover
121—Main Top Panel
122—Cover Side Tuck Panels (2)
123—Fold Lines (2)
124—Cover Front Tuck Panel
125—Front Flap Perforation Fold Line
126—Diagonal Cover Breakdown Score (2)
130—Cover Hinge Score Line
140—Rear wall

141—Fold line
160—Body
161—Main Base Panel
162—Body Breakdown Score
163—Detachable Product Support Pad Breakdown Scores (2)
164—Body Side Panels (2)
165—Fold Lines (2)
166—Back Tuck Flaps (2)
167—Fold Lines (2)
168—Angle Side Panels (2)
168A—Angle Side Panel
168B—Angle Side Panel end tab
169—Fold Assist Bar Scores (4)
170—Detachable Product Support Pad (includes 171, 174 and 176)
171—Main Pad Panel
172—Tearable Pad Hinge Portions (2)
173—Fold Line
174—Body Front Panel
175—Fold Lines (2)
176—Body Front Rollover Panel
177—Elongate Slot
178—Longitudinal Breakdown Line
179—Assembly Tab
200—Blank (Second Embodiment)
1000—Erected Food Container First Embodiment

FIGS. 1-7

Reference is now made generally to FIGS. 1-7, which show a first embodiment of the invention.

Blank 100

Referring now to FIG. 1, a blank 100 comprising a first embodiment of the present invention is provided. The blank 100 will be assumed to be considered "elongate" (having a longitudinal length longer than its transverse width).

The blank 100 includes a cover 120, a rear wall 140, and a body 160. Generally described, the cover 120, when assembled, provides overhead cover to the food product, the body 160 provides support and containment of the food product, and the rear wall 140 provides an interconnection between the cover 120 and the body 160, and also provides containment.

The blank 100 may be composed of corrugated cardboard (e.g., B-Flute or E-Flute) or other suitable material. Indicia and/or graphics may be provided thereon as desired.

Cover 120

The cover 120 includes a main top panel 121, two opposing cover side tuck panels 122, two substantially parallel perf-scored fold lines 123, a cover front tuck panel 124, a front flap perforation fold line 125, and two diagonal cover breakdown scores 126.

The cover side tuck panels 122 are foldably attached relative to the main top panel 121 along fold lines 123. The cover front tuck panel 124 is foldably attached relative to the main top panel 121 by front flap perforation line 125. The cover breakdown scores 126 will be discussed later in this application with respect to final breakdown of the food container.

The cover 120 is foldably attached relative to the rear wall 140 via cover hinge score line 130.

Rear Wall 140

The rear wall 140 is foldably attached relative to the body 160 via perf-scored fold line 141.

Body 160

The body 160 includes a main base panel 161, a body breakdown score 162, two detachable product support pad breakdown scores 163, two body side panels 164, two perf-scored fold lines 165, two back tuck flaps 166, two partial knife cut fold lines 167, two angle side panels 168 (each including angle side panel 168A and angle side panel end tab 168B), four fold assist bar scores 169, a detachable product support pad 170 (which includes a main pad panel 171, a body front panel 174, and a retention flap 176), two tearable pad hinge portions 172, and a longitudinal breakdown line 178.

The main base panel 161 is substantially planar. Body side panels 164 are foldably attached relative to the main base panel 161 via fold lines 165. The back flaps 166 are attached relative to the body side panels 164 via fold lines 167. The angle side panels 168 could be considered slightly "J-shaped" and extend from the body side panels 164, with a fold assist slit 169 providing a folding assist feature to allow the angle side panels 168 to be folded relative to the body side panels 164 as discussed later in this application. It may be understood that small material "nicks" may be left in an otherwise complete cut to attach the angle side panels 168B to the detachable product support pad 170 when the blank 100 is flat. These nicks may be easily broken during the erection process.

Detachable Product Support Pad 170

The detachable product support pad 170 is foldably attached relative to the main base panel 161 of the body 160, via the two tearable pad hinge portions 172. The detachable product support pad 170, as mentioned above, includes a main panel 171, a body front panel 174 and a body front rollover panel 176. As described elsewhere in this application, the detachable product support pad 170 is configured to be torn away from the remainder of the blank (or food container, depending on its erection state), should it become soiled and require disposal separate from the remainder of the blank or food container. The hinge portions can be perforated, partially slit, sufficiently necked down in width, and/or otherwise weakened as needed. The goal is to allow for enough structure to keep the blank together prior to folding, but to allow suitable tearing by the hands of a user, preferably without tools.

The main pad panel 171 is substantially planar, and includes a plurality of detachable product support pad breakdown scores 163, for breakdown as discussed later in this application.

The body front panel 174 is foldably attached relative to the main pad panel 171 via fold line 173, which extends adjacent elongate slot 177. The body front rollover panel 176 is foldably attached relative to the body front panel 174 by a pair of slightly spaced apart fold lines 175. As will be understood later in this description, these fold lines 175 are spaced apart so as to allow the body front panel 174 and the body front rollover panel 176 to "sandwich" the angle side panel tabs 168*b* therebetween when the blank 100 formed into an assembled food container 1000. The elongate slot 177 is configured to accept an assembly tab 179 during the final step of the body erection process described elsewhere in this application.

Erection of Blank 100 into Erected Food Container 1000

FIGS. 2-7 illustrate the various steps involved in erecting the food container from blank 100 in accordance with an embodiment of the present invention.

The erection of the blank 100 of FIG. 1 is shown in FIGS. 2-5 to form the assembled carton or food container 1000 of FIGS. 6 and 7. This provides a storage location for the food product.

In the FIG. 2 illustration, the blank is shown in its substantially flat configuration similar to that shown in FIG. 1. As may be seen, this blank 100 includes cover 120, rear wall 140 and body 160, which itself includes a detachable product support pad 170. The fold lines 130, 141, and 172 are substantially coparallel and spaced apart. The two tearable hinge lines 172 both lie along substantially the same axis, and together could be considered to comprise a "tearable hinge", which in one embodiment is noncontiguous and includes at least the two spaced apart portions, although other embodiments are contemplated. The cover 120 and rear wall 140 may be together considered a "top cover member".

In FIG. 3, the detachable product support pad 170 is folded along tearable pad hinge portions 172 relative to the main base panel 161, such that the detachable product support pad 170 is eventually situated in the position as shown in FIG. 4. As may be seen, the detachable product support pad 170 is folded from its blank position over on top of the main base panel 161, to form a double thickness at least in places. During this folding process, it may be seen that the body from panel 174 and the body front rollover panel 176 likewise pivot about the tearable pad hinge portions 172.

Now referring to FIGS. 4 and 5, the body 160 is erected. To do so, as shown in FIG. 4, the body side panels 164 are folded initially in the direction shown in FIG. 4 towards their final position shown in FIG. 5. At about the same time, the back flaps 166 are folded into place, as are the angle side panels 168. As may be seen, the angle side panel end tabs 168B are folded relative to the angle side panels 168A, such that they are at their final positions shown in FIG. 5. In the position shown in FIG. 5, it may be seen that the short "stubs" (not numbered) on the angle side panel end tabs 168B are located within the elongate slot 177. At this point as shown in the arrow in FIG. 5, the body front panel 174 and body front rollover panel 176 are folded into place, such that they "sandwich" the angle side panel end tabs 168*b*. In order to secure the body front rollover panels 176, assembly tab 178 is inserted within the elongate slot 177.

FIG. 6 shows a configuration in which the blank is be considered to be "erected" (although not yet closed) into a food container or carton 1000 in that it is configured to accept a food product FP atop the detachable product support pad 170, which may be understood to be inverted relative to the position of the FIG. 2. At this point, the cover side tuck panels 122 and cover front tuck panel 124 can be folded as shown in FIG. 6, such that they are configured to be in the relative positioning shown in FIG. 7, such that the cover side tuck panels 122 and cover front tuck panel 124 fit within the enclosure when it is closed.

During conventional intended use of the pizza box, the main top panel is configured to be positioned above said food product, while the detachable product support pad defines a floor portion of said storage location, upon which the food product will be supported.

Upon use of the food container or carton 1000 as a food container, it may be readily understood that the food product may soil at least a portion of the carton, in particular the detachable product support pad.

Upon use of the food container or carton 1000, should the main pad panel 171 become soiled by food product, the detachable product support pad 170 may be torn away from the remainder of the carton 1000, specifically by the tearing of the two tearable pad hinge portions 172.

To generally show the portion that is being torn away, the hatched portion in FIG. 8 may be referenced generally. Although FIG. 8 is a different, second, embodiment, the same general concept applies in that the hatched portion is the part that is torn away.

Use of Erected Food Container 1000

The erected food container 1000 may be used as understood to contain and transport any product, including food but not limited to pizza. Once the erected food container has served its purpose and is to be discarded, the removable trash pad portion, if soiled, can be torn away from the remainder of the food container along the tearable pad hinge portions 172. The two separated portions can then be separately discarded as appropriate.

The "recyclable" (preferably unsoiled or minimally soiled) portion can then be separated or folded along breakdown scores 126 and 162.

The soiled detachable product support pad 170 can be torn apart or folded along detachable product support pad breakdown scores 163 as desired for purposes of compacting.

Second Embodiment

FIG. 8

Referring now to FIG. 8, a blank 800 comprising a second embodiment of the present invention is provided.

FIG. 8 shows a second embodiment, which includes breakdown perforation lines 263A and 263B. As may be seen, these breakdown lines are slightly different from the detachable product support pad breakdown scores shown as 163 as referenced above, and that the longer perforation lines 263A is substantially transverse relative to the elongate blank, whereas the shorter one 263B is substantially along the longitudinal axis of the elongate blank. Other than this final breakdown accommodation, the blanks 100 and 800 are similar.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claim concepts.

That which is claimed:

1. A pizza box, formed from a single blank, the pizza box defining a storage location for containing a food product, the storage location being partially defined by a floor portion for supporting the weight of the food product, the pizza box comprising:

a cover itself comprising at least a main top panel configured to be positioned above the food product;

a rear wall connected relative to the top panel; and a body itself including:

a main base panel attached to the rear wall; and a detachable product support pad attached to the main base panel along a tearable hinge, the main base panel and the detachable product support pad being folded along the tearable hinge such that at least a portion of the detachable product support pad overlies and is in contact with at least a portion of the main base panel to form an overlaid double thickness portion, wherein the tearable hinge is noncontiguous and includes at least two spaced apart hinge portions, wherein the blank is formed into a pizza box, the detachable product support pad is spaced apart from the top panel of the cover to at least partially define the food product storage location therebetween, such that the detachable product support pad defines the floor portion of the storage location and such that the detachable product support pad can be detached.

2. The pizza box of claim 1, wherein the detachable product support pad is configured to be detached relative to the main base panel of the body of the pizza box by tearing along the tearable hinge, such that the detachable product support pad may be disposed of in a location different from the remainder of the pizza box.

3. The pizza box of claim 2, wherein the at least two spaced apart hinge portions are substantially along the same axis.

4. The pizza box of claim 3, wherein the rear wall is attached relative to the main base panel along a first fold line, and the tearable hinge lies along a second fold line, and the first and second fold lines are substantially parallel.

5. The pizza box claim 2, wherein the rear wall is attached relative to the main base panel along a first fold line, and the tearable hinge lies along a second fold line, and the first and second fold lines are substantially parallel.

6. The pizza box of claim 1, wherein the detachable product support pad includes a body front panel configured to form a front panel of the food container.

7. A method of forming a pizza box defining a storage location for containing a food product, the storage location being partially defined by a floor portion for supporting the weight of the food product, the method comprising the steps of:

providing a blank itself including:

a cover itself including at least a main top panel configured to be positioned above the food product;

a rear wall connected relative to the top panel; and a body itself including:

a main base panel attached to the rear wall; and a detachable product support pad attached to the main base panel along a tearable hinge, the main base panel and the detachable product support pad being folded along the tearable hinge such that at least a portion of the detachable product support pad overlies and is in contact with at least a portion of the main base panel to form an overlaid double thickness portion, wherein the tearable hinge is noncontiguous and includes at least two spaced apart hinge portions, forming the blank into a pizza box such that the detachable product support pad is spaced apart from the top panel of the cover to at least partially define the food product storage location therebetween, such that the detachable product support pad defines the floor portion of the storage location of the pizza box; and detaching the detachable product support pad by tearing the blank substantially along the tearable hinge.

8. The method of forming a pizza box as claimed in claim 7, further comprising disposing the detachable product support pad in a location different from the remainder of the pizza box.

9. The method of forming a pizza box as claimed in claim 8, wherein the rear wall is folded relative to the main base panel along a first fold line, and the tearable hinge lies along a second fold line, and the detachable product support pad is folded relative to the main base panel along a first fold line being substantially along the tearable hinge, and wherein the first and second fold lines are substantially parallel.

10. The method of claim 7, wherein the detachable product support pad includes a body front panel configured to form a front panel of the food container.

11. A blank for a pizza box, the blank comprising:

a top cover member comprising at least a main top panel configured to be positioned above the food product; and a body itself including:

a main base panel attached to the top cover member along a fold line lying substantially along a first axis; and a detachable product support pad attached to the main base panel along a tearable hinge, the main base panel and the detachable product support pad being folded along the tearable hinge such that at least a portion of the detachable product support pad overlies and is in contact with at least a portion of the main base panel to form an overlaid double thickness portion, wherein the tearable hinge is noncontiguous and includes at least two spaced apart hinge portions, the detachable product support pad being detachable relative to the body by tearing the blank substantially along the tearable hinge.

12. The blank for a pizza box as claimed in claim 11, wherein the top cover member includes a cover including the main top panel, and the top cover member also includes a rear wall connected to the main top panel along a fold line.

13. The blank for a pizza box as claimed in claim 12, wherein the rear wall is attached relative to the main base panel along a first fold line, and the tearable hinge lies along a second fold line, and the first and second fold lines are substantially parallel.

14. The blank for a pizza box as claimed in claim 13, further comprising a side panel foldably attached relative to the main base panel along a third fold line, the second and third fold lines being substantially perpendicular.

15. The blank for a pizza box as claimed in claim 11, further comprising a side panel foldably attached relative to the main base panel.

16. The blank for a pizza box of claim 11, wherein the detachable product support pad includes a body front panel configured to form a front panel of the food container.

* * * * *